US010544766B2

(12) United States Patent
Kukler

(10) Patent No.: US 10,544,766 B2
(45) Date of Patent: Jan. 28, 2020

(54) INJECTING APPARATUS AND METHOD OF USING AN INJECTING APPARATUS

(71) Applicant: RKLAB AG, Root D4 (CH)

(72) Inventor: Ronald Kukler, Root D4 (CH)

(73) Assignee: RKLAB AG, Root D4 (CH)

( * ) Notice: Subject to any disclaimer, the term of this patent is extended or adjusted under 35 U.S.C. 154(b) by 79 days.

(21) Appl. No.: 15/502,760

(22) PCT Filed: Aug. 5, 2015

(86) PCT No.: PCT/EP2015/068022

§ 371 (c)(1),
(2) Date: Feb. 8, 2017

(87) PCT Pub. No.: WO2016/020416

PCT Pub. Date: Feb. 11, 2016

(65) Prior Publication Data

US 2017/0226976 A1 Aug. 10, 2017

(30) Foreign Application Priority Data

Aug. 8, 2014 (GB) ..... 1414097.4

(51) Int. Cl.

| | |
|---|---|
| ***F02M 53/04*** | (2006.01) |
| ***F02M 49/02*** | (2006.01) |
| ***F02M 57/02*** | (2006.01) |
| ***F02M 59/10*** | (2006.01) |
| ***F02M 63/00*** | (2006.01) |

(52) U.S. Cl.

CPC ..... *F02M 53/04* (2013.01); *F02M 49/02* (2013.01); *F02M 57/02* (2013.01); *F02M 59/10* (2013.01); *F02M 63/00* (2013.01)

(58) Field of Classification Search

CPC ..... F02M 53/04; F02M 63/00; F02M 59/10; F02M 57/02; F02M 63/0043;

(Continued)

(56) References Cited

U.S. PATENT DOCUMENTS 2,389,492 A 11/1945 Edwards
4,197,996 A 4/1980 Giardini (Continued)

FOREIGN PATENT DOCUMENTS

DE 10 2008 013 129 A1 9/2009
EP 0601038 A1 6/1994

(Continued)

OTHER PUBLICATIONS

International Search Report for PCT/EP2015/068022, dated Jan. 26, 2016.

(Continued)

*Primary Examiner* — Xiao En Mo

(74) *Attorney, Agent, or Firm* — Marshall, Gerstein & Borun LLP

(57) ABSTRACT

An injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve.

18 Claims, 12 Drawing Sheets

(58) Field of Classification Search
CPC ..... F02M 59/107; F02M 63/004; F02M 63/0049; F02M 49/02; F02M 57/025; F02M 53/043; F02M 2700/075
See application file for complete search history.

(56) References Cited

U.S. PATENT DOCUMENTS

| | | | | |
|---|---|---|---|---|
| 4,427,151 | A | 1/1984 | Trenne | |
| 2002/0092485 | A1* | 7/2002 | Alexius ..... | F02B 71/04 123/46 R |

FOREIGN PATENT DOCUMENTS

| | | | |
|---|---|---|---|
| FR | 2572464 | A1 | 5/1986 |
| GB | 2076073 | A | 11/1981 |
| JP | S62157275 | A | 7/1987 |
| RU | 2101523 | C1 | 1/1998 |
| SU | 1838659 | | 8/1993 |
| WO | WO-95/12067 | A1 | 5/1995 |

OTHER PUBLICATIONS

Written Opinion for PCT/EP2015/068022, dated Jan. 26, 2016.
International Preliminary Report on Patentability for PCT/EP2015/068022, dated Feb. 14, 2017.
Search Report for GB 1414097.4, dated Feb. 5, 2015.
English-language translation of the Office Action issued in Japanese Patent Application No. 2017-504816, dated Jan. 22, 2019.
Office Action Issued in Chinese Patent Application No. 201580042587.5, dated Mar. 18, 2019.
Search Report for Russian Patent Application No. 2017104336, dated Feb. 27, 2019.

* cited by examiner

End injection

INJECTING APPARATUS AND METHOD OF USING AN INJECTING APPARATUS

FIELD OF THE INVENTION

This invention relates to injecting apparatus for injecting a fluid under pressure, e.g. fuel injecting apparatus for internal combustion engines, apparatus for injecting liquids, e.g. a catalyst into chemical reaction vessels under pressure, and other apparatus for injecting a dose of fluid.

BACKGROUND OF THE INVENTION

Although the present invention is applicable to any situation where a measured dose of fluid is to be injected under pressure, it will be convenient to describe the invention with particular reference to injecting fuel into an internal combustion engine.

Fuel injectors used in internal combustion engines, including both spark ignition and compression ignition (or diesel) engines generally utilise an external pump for supplying the fuel under sufficient pressure to be injected into the engine cylinder. The timing of the injection point in the engine operating cycle is determined by externally controlling the operation of an injector valve by mechanical or electrical means. One disadvantage of providing external pumping and control is the need for the provision and servicing of such external systems.

A general problem with injectors, particularly ones supplied from an external pump, is lack of responsiveness to any faulty condition in the associated cylinder. For example, if a piston ring is broken, known injectors will continue to inject fuel charges into the cylinder. Thus fuel will be exhausted from the engine leading to air pollution by exhausted unburnt fuel.

EP0601038 shows an injecting apparatus.

U.S. Pat. No. 4,427,151 shows an injecting apparatus.

SUMMARY OF THE INVENTION

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the piston defines a first piston working area facing an associated chamber, the piston first working area being annular.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the injector valve defines a first valve member movable relative to a second valve member, the second valve member being fixed relative to the body of the injector.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein fluid in the control chamber is controlled by a valve having a movable member biased to a closed position by a bias member, the valve having a first pressure area, pressurisation of which tends to open the valve and a second pressure area, pressurisation of which tends to close the valve, wherein equalisation of the pressure at the first pressure area and at the second pressure area causes the valve to close.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein fluid in the control chamber is controlled by a first solenoid operating a first valve and a second solenoid operating a second valve.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the control chamber is selectively fed from an inlet and the control chamber is selectively vented to a low pressure region via an outlet, the injecting apparatus further including a cooling circuit fed from the inlet and vented to the low pressure region via the outlet.

According to an aspect of the present invention there is provided an injector nozzle for injecting fuel into a combustion chamber of an internal combustion engine, the nozzle including a disc having a plurality of injector orifices situated around a periphery of the disc.

According to an aspect of the present invention there is provided an injector nozzle for injecting fuel into a combustion chamber on an internal combustion engine, the nozzle including at least one injector orifice having a cross-section dimension of less than 0.05 mm, alternatively less than 0.025 mm.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein there is a plurality of associated injector orifices situated around a disc, the disc forming part of an injector nozzle.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the piston is arranged to rotate about an axis in use.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the piston defines the first piston working area facing an associated chamber and the piston defines a second piston working area being in fluid communication with the high pressure chamber, the first piston working area being defined by a first periphery having a first sealing surface for movement relative to a first component of the injector, the second piston working area being defined by a second periphery having a second sealing surface for movement relative to a second component of the injector, wherein the first sealing surface of the piston and the second sealing surface of the piston are fixed relative to each other and the first component of the injector and the second component of the injector are movable laterally relative to each other.

According to an aspect of the present invention there is provided a method of manufacturing an injector orifice including:

providing a first part, providing a second part, providing a concave portion in the second part, joining the first part to the second part so that the concave portion forms at least a part of the injector orifice.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein there is an absence of mechanical devices operating to bias the piston.

According to an aspect of the present invention there is provided an injecting apparatus for injecting a fluid under pressure into an associated chamber, the injecting apparatus including:

a body, a piston movable in the body under the action of fluid pressure in the associated chamber acting from externally against the piston, the piston being operable to compress fluid to be injected in a high pressure chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injection orifice upon opening of the injection valve, wherein movement of the piston occurs solely as a result of fluid pressure acting on the piston.

BRIEF DESCRIPTION OF THE DRAWINGS

The invention will now be described, by way of example only, with reference to the accompanying drawings in which.

DETAILED DESCRIPTION

Figure 1:
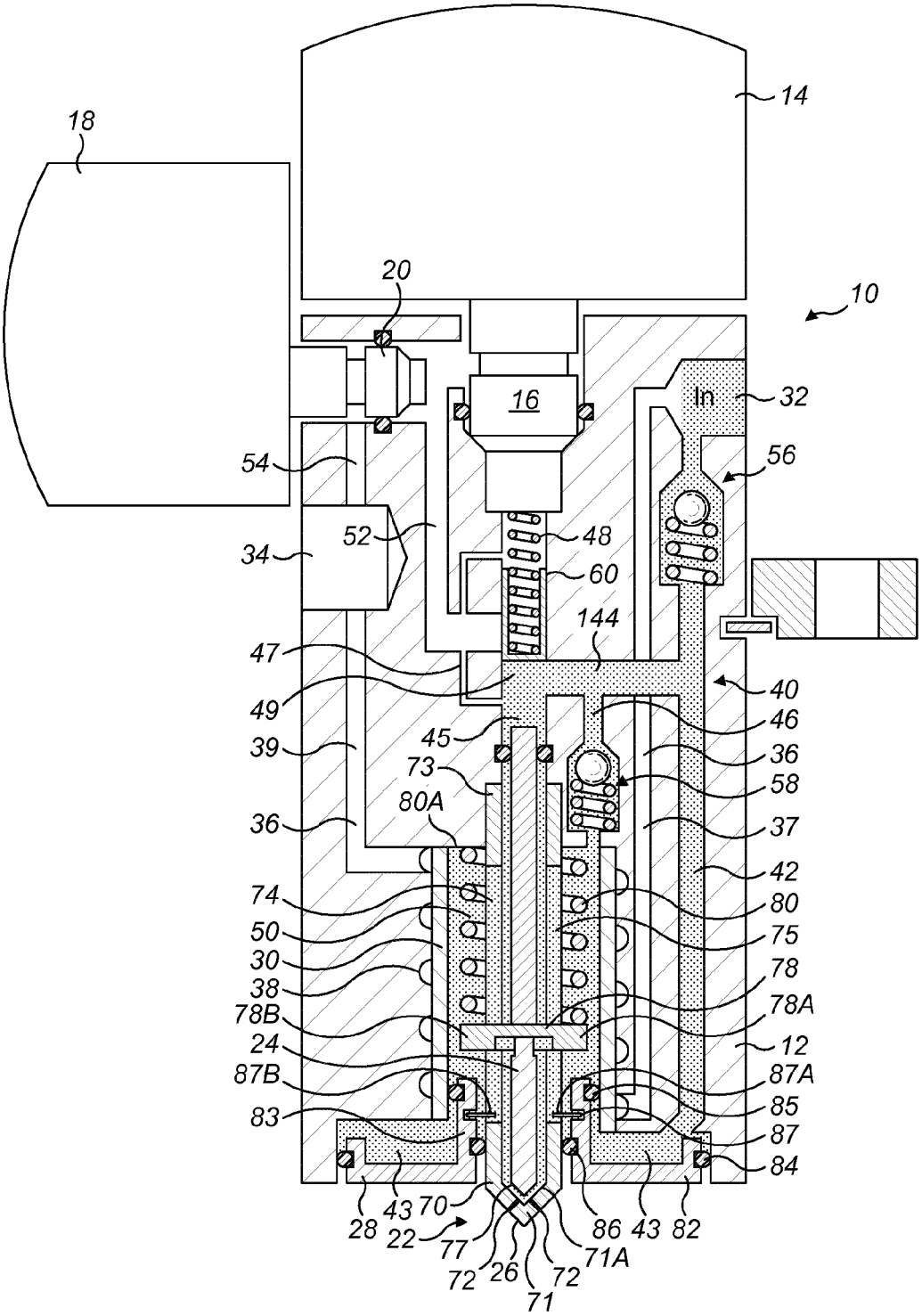
FIG. 1 is a cross-section view of injecting apparatus according to the present invention.

With reference to the figures there is shown an injector 10 having a generally cylindrical injector body 12. Mounted on the top of the injector is a first solenoid 14 which operates a first valve 16. A second solenoid 18 is mounted adjacent the first solenoid and operates a second valve 20. An injector valve 22 is mounted in the body and includes a first valve member 24 and a second valve member 26. A piston 28 mounted in the end of the body opposite the first solenoid. The body includes a cylindrical sleeve 30. The body includes various fluid ports/paths/regions as follows:— inlet port 32 outlet port 34 cooling path 36 comprising path 37, path 38 and path 39 control chamber 40 comprising region 41, region 42, region 43, region 44, region 45, region 46, region 47, region 48 and region 49 high pressure region 50 region 52 outlet path 54

Between inlet port 32 and region 41 is a non-return valve 56, in this case a spring loaded ball valve.

Between region 46 and the high pressure region 50 is a non-return valve 58, in this case a spring loaded piloted ball valve.

Control valve 60 (see especially FIG. 2) includes a valve member 61 defined by a cylindrical wall 62 and a circular end face 63. The control valve 60 is slideable within bore 64 of the injector body 12.

The circular end face 63 faces region 49. Part of the cylindrical wall 62 faces region 52. Part of the valve member 61 faces region 48. Movement of the valve member 61 in the direction of arrow A of FIG. 2 will cause the control valve 60 to open since the circular end face 63 will move up passed the adjacent part of region 52 thereby putting region 49 into fluid communication with region 52.

Figure 2:
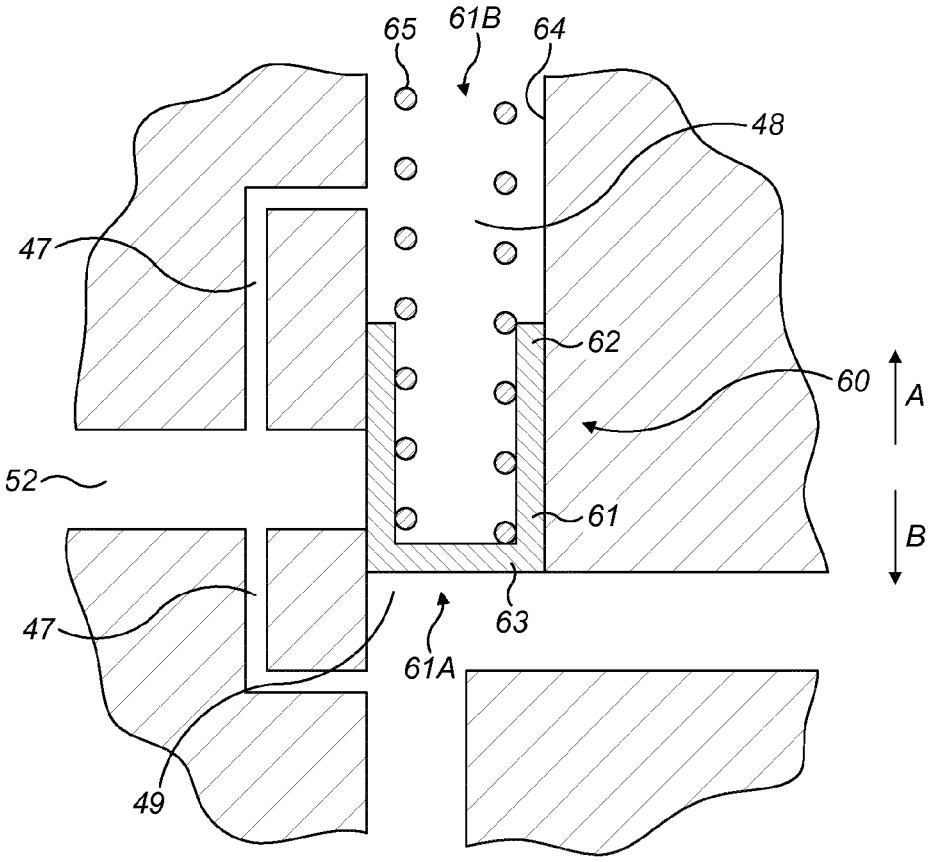
FIG. 2 is an enlarged view of FIG. 1.

A spring 65 biases the valve member 61 in the direction of arrow B of FIG. 2 as will be further described below.

The valve member 61 defines a first working area 61A which faces region 49. Pressure of fluid in region 49 will act on the first working area 61A such that:—

The force in direction of arrow A applied to valve member 61 equals the pressure in region 49 times the first working area 61A.

In this case the first working area is equivalent to a cross section area of the valve member 61.

The valve member 61 also defines the second working area 61B which faces region 49. Pressure of fluid in region 49 will act on the working area 61B such that:—

The force in the direction of arrow B applied to valve member 61 equals pressure in region 48 times the second working area 61B. In this case the second working area 61B is the same as the first working area 61A.

The second valve member 26 is generally elongate and has a generally cylindrical wall 70 connected to a conical end face 71. The conical end face 71 has a plurality of injector orifices 72. At an end of the generally cylindrical wall 70 opposite the conical end face 71, the generally cylindrical wall includes a male screw thread 73 which allows the second valve member to be screwed into engagement with a female screw threaded hole of the body thereby ensuring that the second valve member can be rigidly attached to the body. The generally cylindrical wall 70 includes two longitudinally orientated grooves 74 and 75.

The first valve member 24 is defined by a pin 76 and a cross pin 78. The pin 76 is generally elongate and includes a conical end 77 which selectively engages the conical internal surface 71A of the conical end face 71 thereby selectively closing the injector valve as will be further described below. The first valve member also includes a spring abutment in the form of the cross pin 78 having ends 78A and 78B. The cross pin 78 is in form fitting engagement with the pin 76. End 78A projects sideways when viewing FIG. 1 through groove 75 and end 78B projects sideways in the opposite direction through groove 74. Spring 80 acts on ends 78A and 78B and biases the cross-pin 78 and hence the pin 76 generally downwardly when viewing FIG. 1.

End 80A of spring 80 engages an abutment on the injector body 12. Accordingly, the first valve member 24 can move in the direction of arrow A and in the direction of arrow B as will be further described below, whereas the second valve member 26 is fixed rigidly to the injector body 12 and hence cannot move in either direction A or direction B.

The piston 28 includes a generally circular disc 82 coupled to an upstanding generally cylindrical wall 83. Seal 84 seals a peripheral edge of the generally circular disc 82 against a recess of the injector body 12. Seal 85 seals the generally cylindrical wall 83 against an inner surface of the cylindrical sleeve 30. Seal 86 seals an inner surface of the generally cylindrical wall 83 against an outer surface of the generally cylindrical wall 70 of the second valve member 26. Accordingly, the piston can move in the direction of arrow A and in the direction of arrow B relative to the injector body 12 as will be further described below. A circlip 87 is received in a circular groove on the inside of the generally cylindrical wall 83. The circlip includes two inwardly pointing fingers 86A and 86B which are received in the grooves 75 and 74 respectively of the second valve member 26. The circlip limits the amount of movement the piston can make in the direction of arrow B by the fingers 86A and 86B abutting the ends of grooves 75 and 74.

Figure 3:
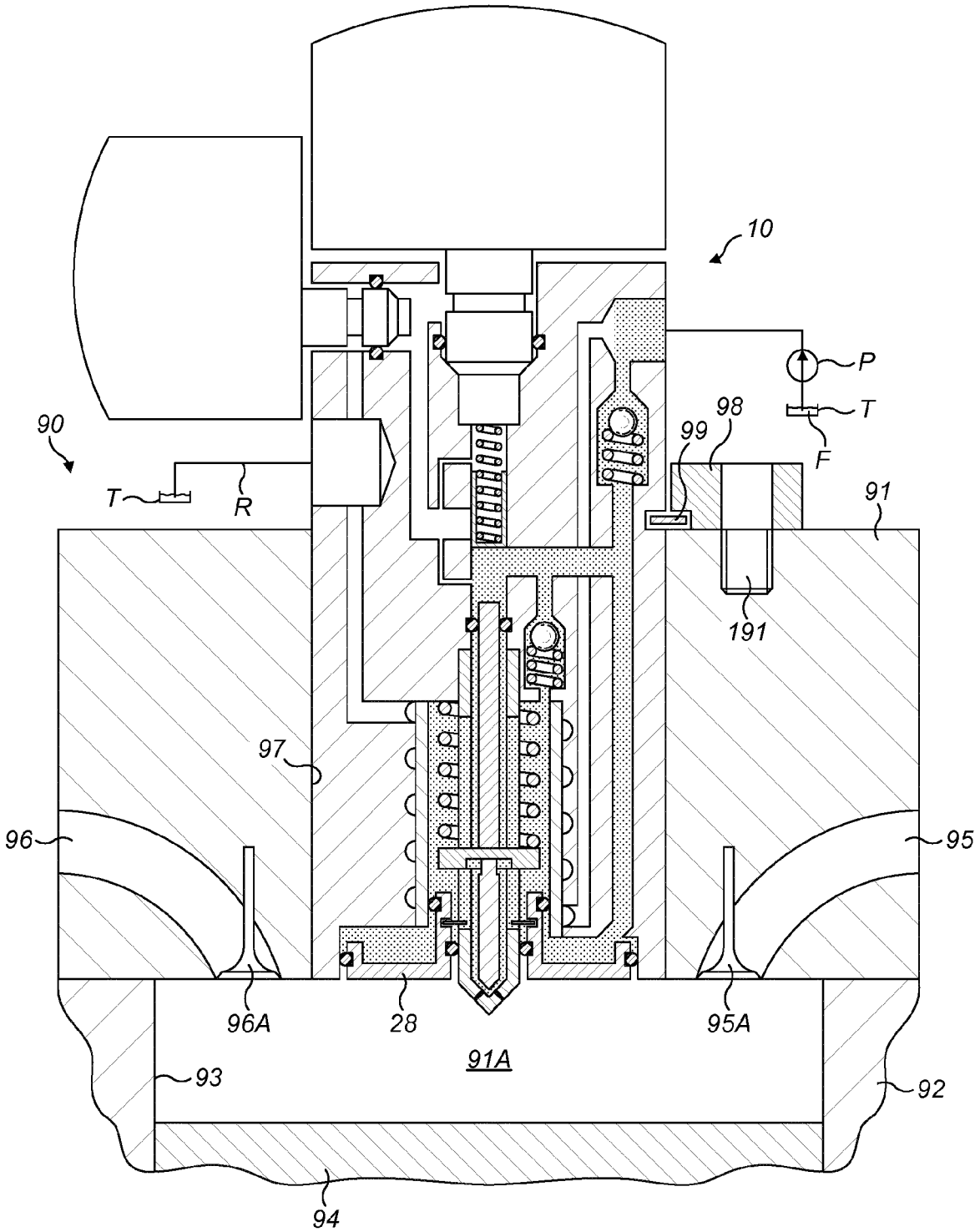
FIG. 3 shows the injecting apparatus of FIG. 1 stored in an internal combustion engine.

The injector 10 is used to inject fuel into a combustion chamber 91A of an internal combustion spark ignition engine 90 (see FIG. 3). The engine has a cylinder head 91 and a cylinder block 92 containing a cylinder 93 within which a reciprocating piston 94 moves. The cylinder head includes an inlet port 95 having inlet valve 95A and an exhaust port 96 having an exhaust valve 96A. The injector 10 is inserted into a hole 97 in the cylinder head such that the piston 28 is exposed to pressure within the combustion chamber 91A.

The injector can be clamped in position via clamp 98, clamping circlip 99 (only part of which is shown in FIG. 3). The clamp 98 is held in place by a bolt (not shown) passing through the clamp and which is threaded into hole 191 in the cylinder head 91.

A fuel pump P pumps fuel F from fuel tank T into the inlet port 32 as will be further described below. A return line R transfers fuel from the outlet port 34 back to tank T.

In this case the engine 90 is a four stroke diesel engine which operates in a conventional manner that is to say an induction stroke draws air in through inlet port 95 past valve 95A into the cylinder 93 as the piston 94 descends. A compression stroke than occurs as the piston 94 moves towards the cylinder head. The injector 10 then injects fuel at an appropriate time which ignites and causes the piston to descend on a power stroke generating power, following which the piston moves towards the cylinder head whilst the valve 96A is open allowing exhaust products to be expelled though the exhaust port 96 (the exhaust stroke). The sequence then repeats itself.

Figure 4:
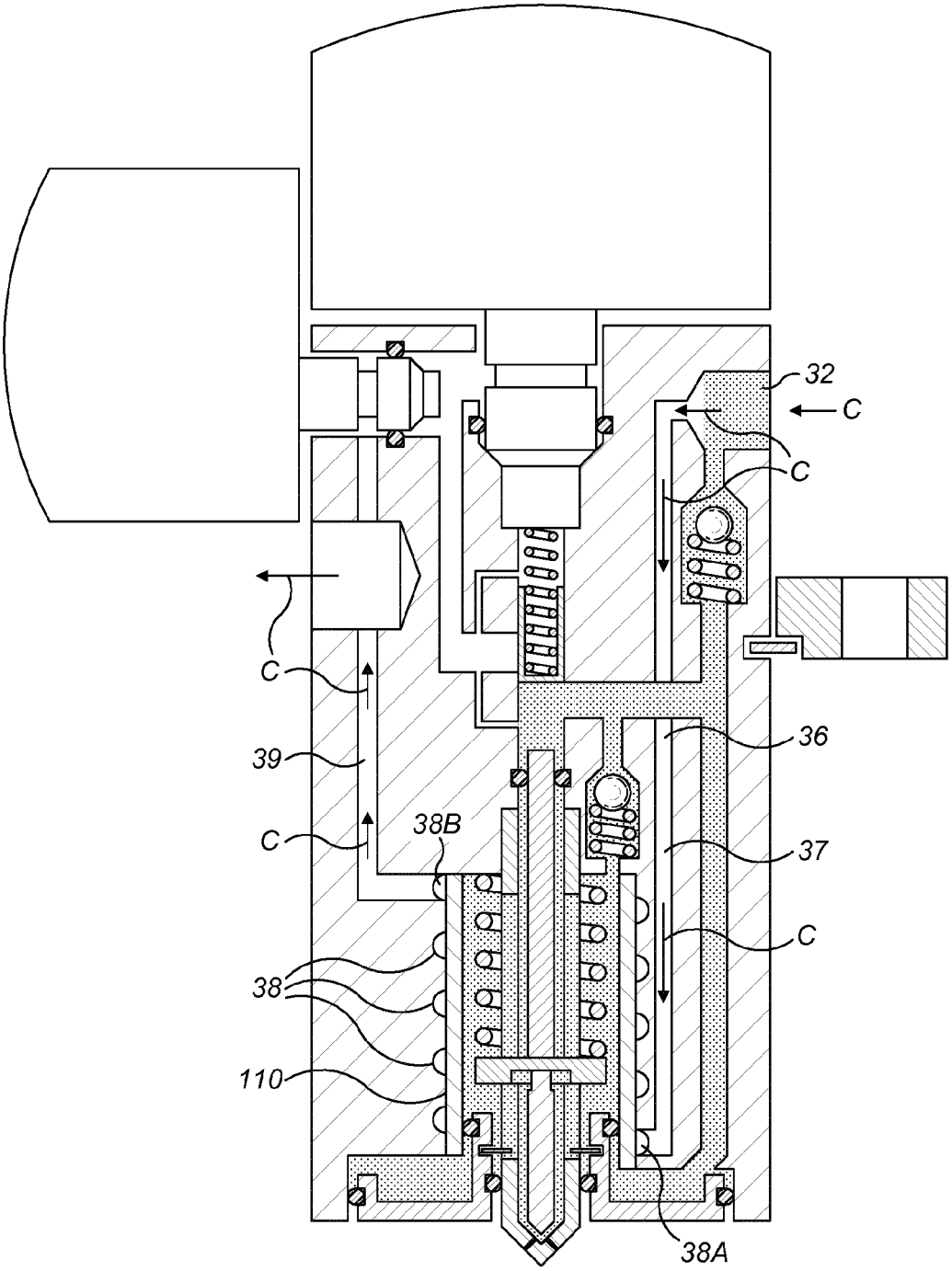
FIG. 4 is a further view of FIG. 1 showing a cooling circuit.

With reference to FIG. 4, path 38 of cooling path 36 is helical and is machined into a cylindrical recess 110 of injector body 12 prior to assembling any of the components into the body, in particular prior to assembling the cylindrical sleeve 30 into the body 12. Once the helical groove that defines path 38 has been machined, the sleeve 30 can be press fitted in thereby creating a helical path 38. One end 38A of path 38 is in direct fluid communication with path 37 and opposite end 38B of path 38 is in direct fluid communication with path 39.

In use, pump P pumps fuel F from tank T into inlet port 32. Some of that fuel than passes into the cooling path 36 by passing first into path 37, then through end 38A of path 38, then through path 38, then through end 38B of path 38, then through path 39, then through outlet port 34 and along return line R back to tank T. Arrow C of FIG. 4 show this flow path. As the fuel F leaves tank T it will be cooler than the cylinder head of the engine and therefore as the fuel flows, in particular around path 38 it will absorb heat from the injector, thereby cooling the injector. The now warm fuel will be returned to tank T where it will dissipate heat to atmosphere.

Operation of the injector during the induction, compression, power and exhaust strokes of the engine is as follows:—

Injector Filling

Figure 5:
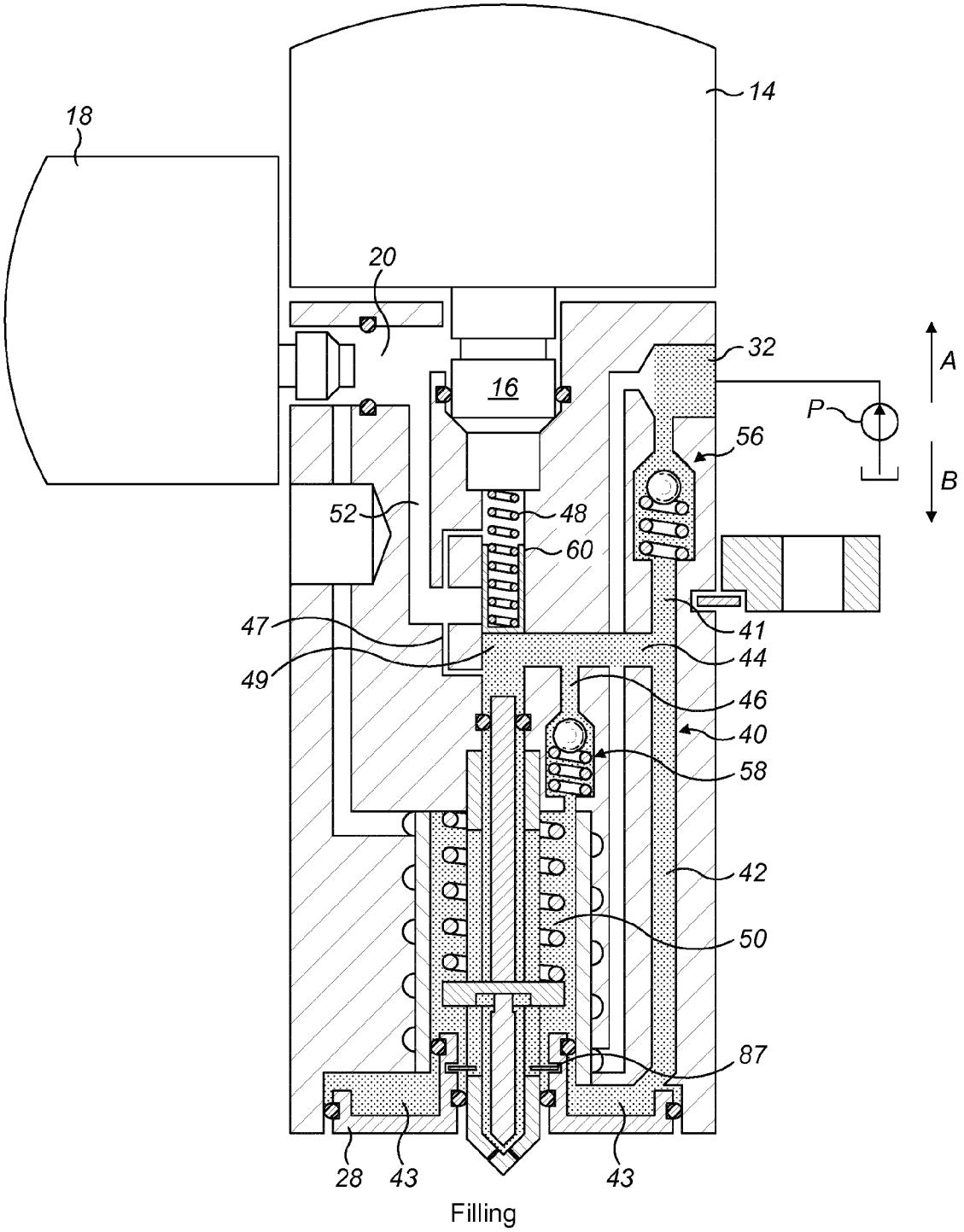
FIG. 5 shows the injecting apparatus of FIG. 1 during a filling process.

FIG. 5 shows how the high pressure chamber 50 of the injector is filled.

The first solenoid 14 is operated so that the first valve 16 is in a closed position (the first solenoid 14 and valve 16 are configured such that the valve 16 is normally closed, i.e. when the first solenoid 14 is not powered, i.e. no electrical current is flowing through the coils of the first solenoid, valve 16 is closed). The second solenoid 18 is operated such that the second valve 20 is in an open position (the second solenoid 18 and second valve 20 are configured such that second valve 20 is normally open, i.e. second valve 20 is open when no power is supplied to solenoid 18). Because region 47 fluidly couples region 49 to region 48, and because region 48 is not fluidly coupled to region 52 (since valve 16 is closed) then the pressure in region 49 and region 48 is the same, and the hydraulic pressure on opposite sides of the valve member 61 is therefore the same. Thus, the force acting in the direction of arrow A created by the pressure in region 49 acting on the first working area 61A is equal to the force acting in the direction of arrow B on the valve member 61 created by the pressure in region 49 acting on the second working area 61B (since the pressure in regions 48 and 49 is the same and since the first working area 61A is the same area as the second working area 61B). In view of this spring 65 acts on valve member 61 to force it in the direction of arrow B, thereby closing control valve 60. The pressure from pump P at inlet port 32 causes non-return valve 56 to open and hence fuel flows from the inlet port 32 into the control chamber 40, i.e. into region 41 and from there into region 42 and 43. Some fuel flows from region 41 into region 44 and from there into region 46. Fuel flowing into region 46 causes the return valve 58 to open allowing fuel to flow into the high pressure region 50. Fuel also flows from region 44 to region 49 and from there to region 45. Fuel cannot pass into region 52 since, as mentioned above, control valve 60 is closed.

Since fluid can flow into region 43 and can also flow into high pressure region 50, then this allows the piston 28 to move in the direction of arrow B as region 50 and region 43 fill with fuel.

As will be appreciated, the forces acting on the piston are a combination of the instantaneous pressure in high pressure region 50, the instantaneous pressure in the control chamber 40, and the instantaneous pressure in the combustion chamber 91A. In particular the instantaneous pressure in the combustion chamber 91A will be below atmospheric pressure during certain periods of the combustion cycle, in particular during the induction stroke. Accordingly, it can be arranged for the piston 28 to move in the direction of arrow B such that the high pressure region 50 and region 43 fills with fuel as the volume of the high pressure region 50 and region 43 increases due to movement of piston 28.

Note that circlip 87 and fingers 87A and 87B limit the amount of movement piston 28 can make in the direction of arrow B, i.e. the circlip 87 prevents the piston 28 "falling" into the cylinder head.

Once the injector has been filled (or primed) then later on during the four stroke cycle, during the compression stroke, pressure in the cylinder head will start to increase thereby acting on piston 28. However, since control valve 60 is closed, and since non-return valve 56 and 58 will close, the control chamber 40 will become hydraulically locked and hence will prevent movement of the piston in the direction of arrow A.

Start of Injection

Figure 6:
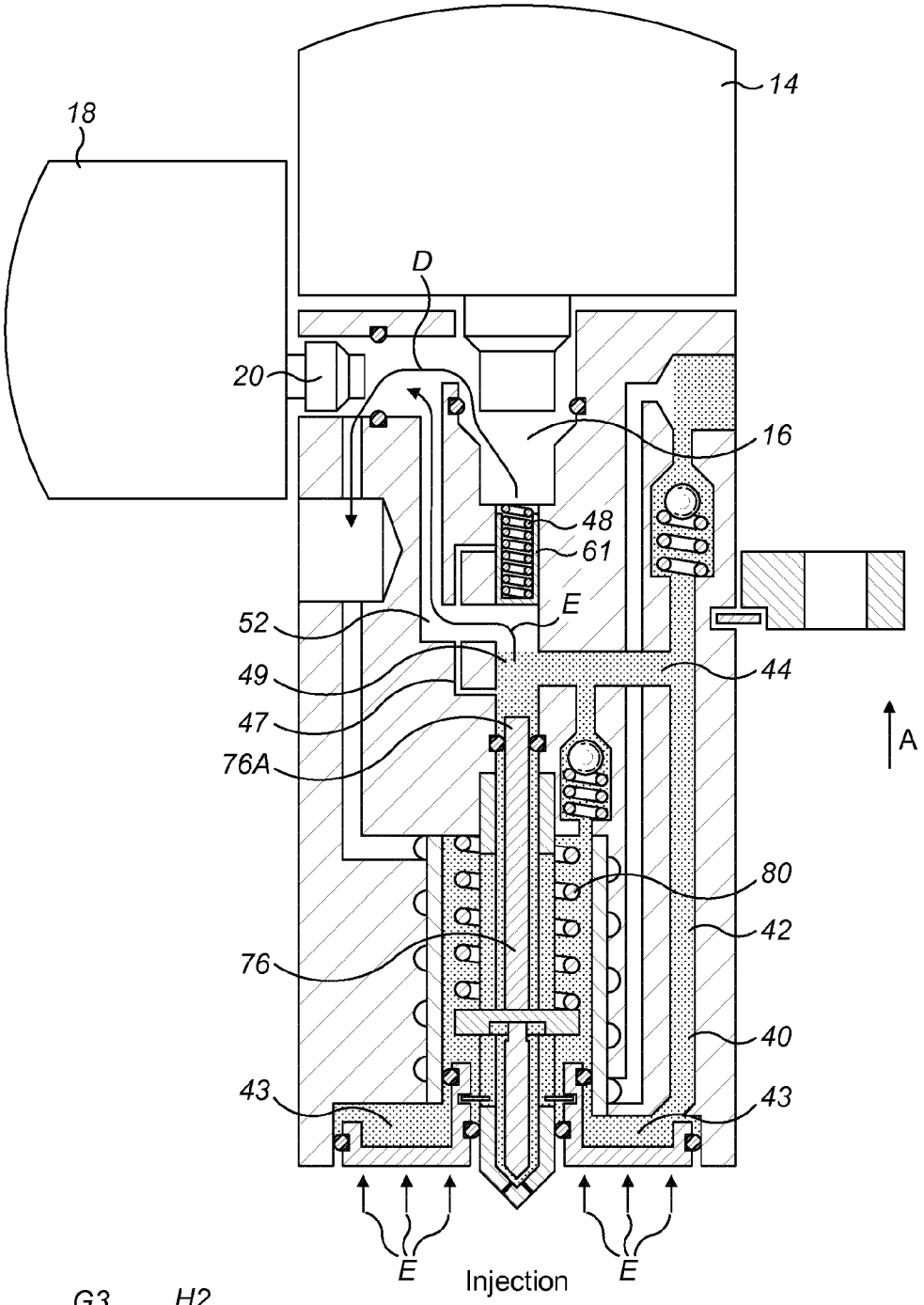
FIG. 6 shows the injecting apparatus of FIG. 1 during an injection process.

FIG. 6 shows how injection is started.

In order to start injection the first solenoid 14 is operated to open the first valve 16. The second valve 20 remains open.

With valve 16 open fluid in region 48 can flow passed valve 16 and passed valve 20 and into the outlet port 34 as shown by arrow D of FIG. 6 and on into a low pressure region i.e. onto the tank T. This results in the fuel pressure in region 48 falling, in particular to below a pressure that is encountered in region 49. Region 47 is relatively narrow and acts as a restrictor as flow passes from region 49 to region 48. This restriction causes a pressure drop as the fluid flows along region 47 resulting in a lower pressure at region 48 than at region 49. There is therefore a lower pressure acting on the second working area 61B than on the first working area 61A this pressure differential is sufficient to overcome the force of spring 65 resulting in valve member 61 moving in the direction of arrow A to the position shown in FIG. 6 thereby opening the control valve 60 and allowing fluid in region 49 to flow into region 52 and out through the outlet port 34 (see arrow E).

Opening of the control valve 60 as just described results in the low pressure region 40 no longer being hydraulically locked. The combustion chamber pressure (represented by arrows E of FIG. 6) acting on the annular face of the piston 28 is no longer reacted by the pressure in region 43 (since this is now vented to a low pressure region (i.e. to tank) via region 42, 44, 49, 52 and the outlet port 34). The pressure acting on the piston 28 therefore is only reacted by the pressure in the high pressure region 52.

Figure 7:
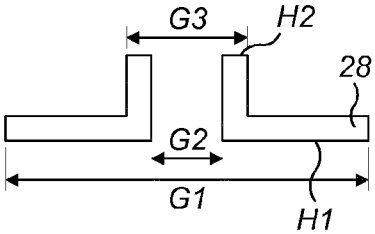
FIG. 7 shows a schematic enlarged view of the piston of FIG. 1.

FIG. 7 shows a simplified view of piston 27 in isolation. The piston has a large external diameter G1 and an internal diameter G2. As will be appreciated, the pressure within the cylinder head acts on a working area H1:

$$H1 = \left(\pi \times \frac{G1^2}{4}\right) - \left(\pi \times \frac{G2^2}{4}\right)$$

The fuel in high pressure region 50 acts on a working area H2:

$$H2 = \left(\pi \times \frac{G3^2}{4}\right) - \left(\pi \times \frac{G2^2}{4}\right)$$

Therefore the pressure in the high pressure region 50 is H1/H2 times larger than the pressure within the cylinder head. The piston 28 therefore acts to multiply the cylinder pressure in respect of the pressure within the high pressure region 50.

The pin 76 is in sliding engagement with seal 76A. Seal 76A in turn is sealed to a bore of the injector body 12. Thus, region 45 is isolated from high pressure region 50. Region 45 forms part of control chamber 40, which, as shown in FIG. 6, is vented to a low pressure region i.e. to tank T thus that part of pin 76 below (when viewing FIG. 6) seal 76A is subject to high pressure (i.e. the pressure in high pressure region 50) whereas that part of the pin above seal 76A is subject to the pressure in the control chamber 40, which, with control valve 60 open, is a vented pressure. Accordingly, pressure differential between high pressure region 50 and the control chamber 40 is sufficient to move the pin 76 upwardly, against the action of spring 80 thereby disengaging conical end 77 from conical internal surface 71A and hence opening the injector valve 22 and allowing fuel to be injected into the cylinder head through the injector orifices 72.

As will be appreciated, the fuel will be being injected at the instantaneous pressure of fuel in the high pressure region 50, which will be H1/H2 times greater than the instantaneous pressure in the cylinder head.

End of Injection

Figure 8:
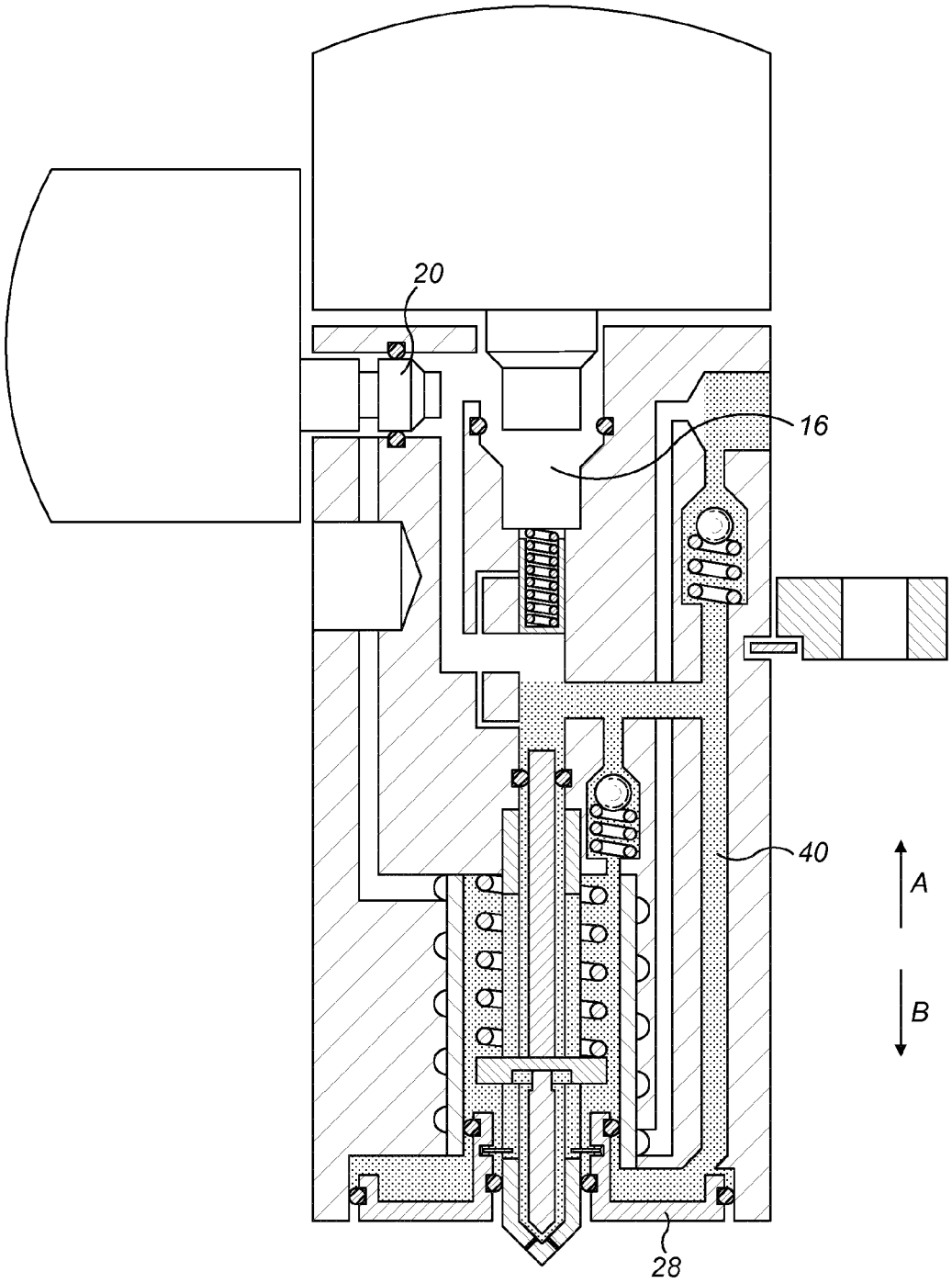
FIG. 8 shows the injector apparatus of FIG. 1 at the end of injection.

In order to stop injection the control chamber 40 is caused to hydraulically lock. This is done by closing the second valve 20 as shown in FIG. 8. Once second valve 20 has closed the piston 28 can no longer move in the direction of arrow A due to the hydraulic locking of the control chamber 40. Once the piston 28 stopped moving in the direction of arrow A then the volume of the high pressure region 50 stops decreasing and hence injection of fuel ceases.

FIG. 8 has been drawn as of the instant that valve 20 closes. At this instant control valve 60 is still open.

Figure 9:
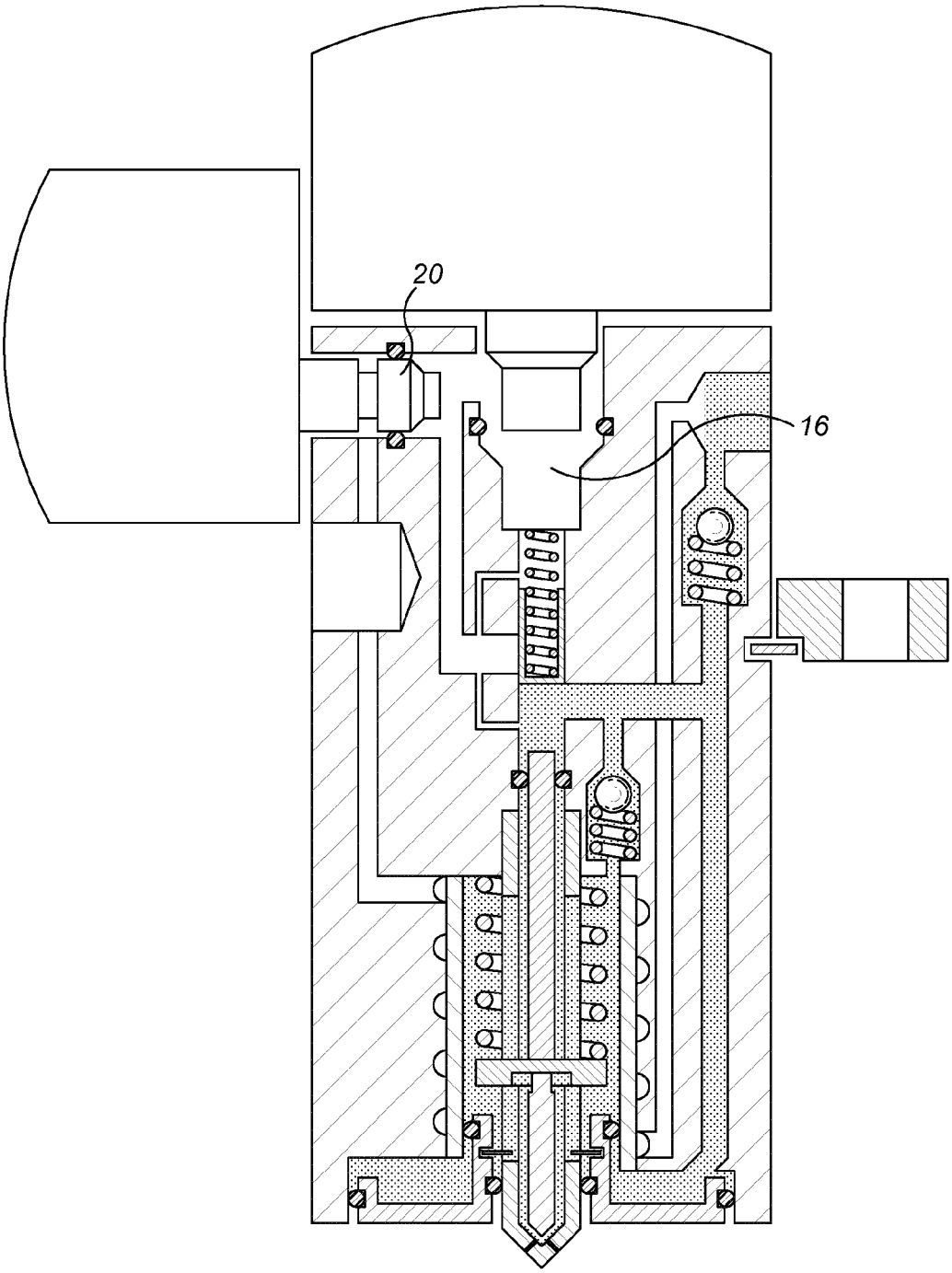
FIG. 9 shows the injecting apparatus of FIG. 1 in a further position.

Very soon after closing of valve 20 the pressure within regions 48 and 49 will equalise (via region 47) thereby causing the spring 65 to move the valve member 61 in the direction arrow B thereby closing the control valve 60. This is shown in FIG. 9.

Figure 10:
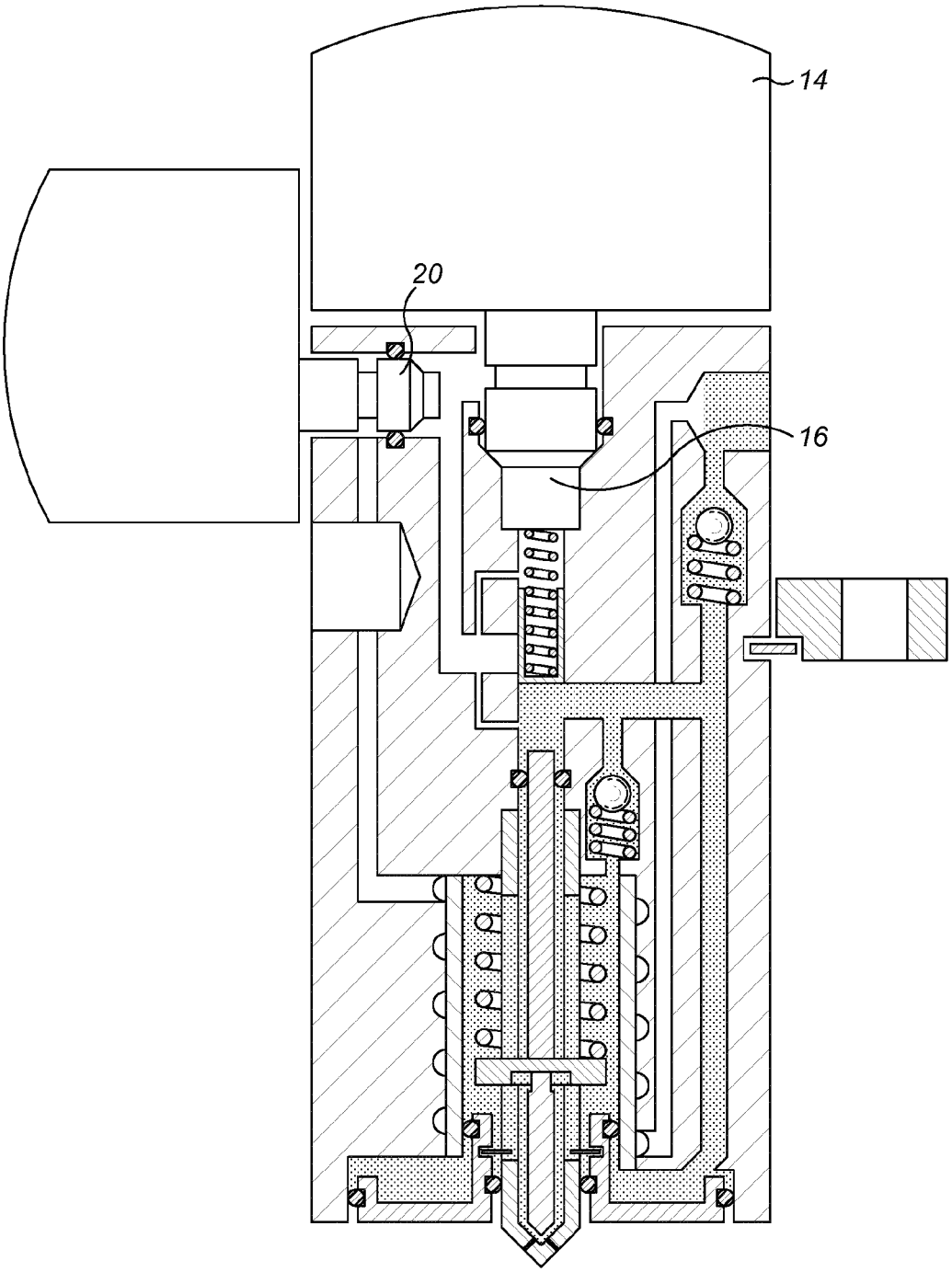
FIG. 10 shows the injecting apparatus of FIG. 1 in a further position.

Valve 16 can then be closed (as shown in FIG. 10).

Valve 20 can then be opened (as shown in FIG. 5) thereby enabling refilling (or priming) of the high pressure chamber 50 ready for the next injection episode.

In further embodiments alternative injector valves could be used, for example a pintle injector valve could be used. Pintle injector valves are well known where a first valve member is moveable relative to a second valve member to selectively define an injection orifice.

Figure 11:
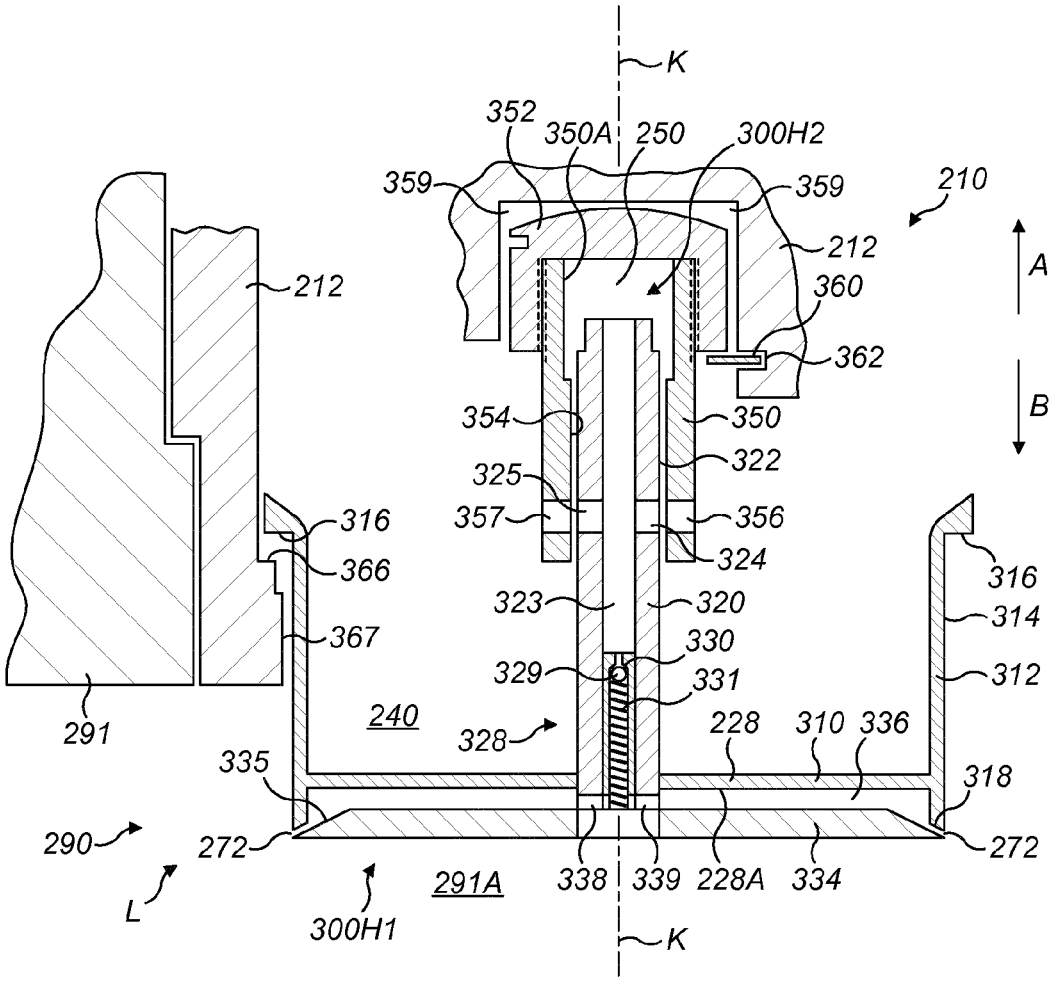
FIG. 11 shows part of a cross-section view of a further embodiment of an injecting apparatus according to the present invention.
Figure 13:
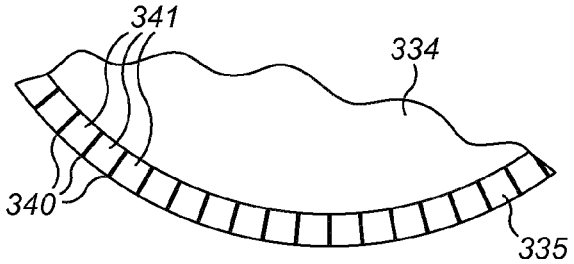
FIG. 13 shows part of the injecting apparatus of FIG. 11 taken in the direction of arrow B.

With reference to FIGS. 11 and 13 there is shown a further embodiment of an injector 210 in which components that fulfil substantially the same function as those of injector 10 are labelled 200 greater.

Figure 12:
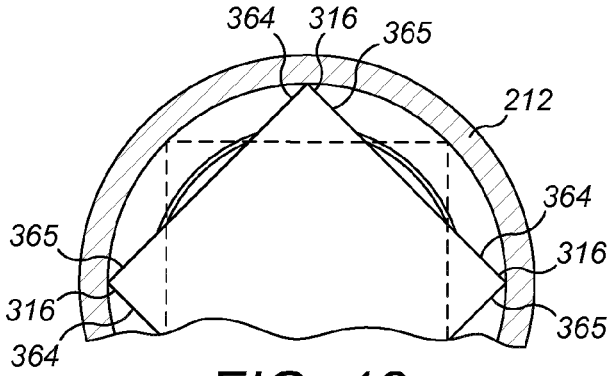
FIG. 12 shows a cross-section of the injecting apparatus of FIG. 11 taken in the direction of arrow B.

The piston 228 includes a generally flat disc 310 attached out an outer periphery to a generally cylindrical part 312. Part 312 has an outer surface 314 and an abutment 316. Abutment 316 is not a continuous annular abutment, rather it consists of four discrete abutments (three of which are shown in FIG. 12). Each abutment 316 has two circumferentially orientated edges 361, 365, the purpose of which will be further described below.

Part of the cylindrical part 312 depends downwardly from the flat disc 310 terminating at an angled edge 318. Depending upwardly from the centre of the disc 310 is a cylinder 320 having an outer surface 322 and a central bore 323. Cylinder 320 has a cross drilling defining laterally orientated holes 324 and 325. Positioned in a lower part of the central bore 323 is a non-return valve 328 having a ball 329 biased upwardly into engagement with a seat 330 by a spring 331. Attached to a lower part of the cylinder 320 is a disc 334. Disc 334 is spaced from the lower surface 228A of piston 228 thereby defining a region 336. An outer peripheral edge 335 of the disc 334 is angled to match the angle of angled edge 318. Cross-drillings 338 and 339 enable central bore 323 to be in fluid communication with region 336.

Edge 335 of disc 334 is generally conical in shape but includes a series of grooves 340 (see FIG. 13) orientated generally radially. Between each groove is a part conical shaped land 341. Each groove is shallow, for example 0.025 mm deep.

The disc is assembled onto the lower part of the cylinder 320 and welded into place such that the lands 341 engage the angled edge 318 of generally cylindrical part 312. The grooves 340 in conjunction with the lands 341 and angled edge 318 therefore define a series of injector orifices 272.

The high pressure region 250 is defined in part by cylinder 350 which is welded (typically by laser welding) to cap 352. Cap 352 therefore blanks off the end 350A of cylinder 350. The cylinder 350 has an inner surface 354 and cross drillings 356 and 357 orientated laterally. Cap 352 is received in a recess 359 of the injector body 212. The diameter of cap 352 is a loose fit in recess 359 for reasons that will be further described below.

A circlip 360 is received in a groove 362 of the body to prevent the cylinder 350 and the cap 352 moving in the direction of arrow B.

The injector body 212 has an annular abutment 366 and a cylindrical inner surface 367.

The principal of operation of injector 210 is similar to that of injector 10.

Thus the high pressure region 250 can be primed from the control chamber 240 as the piston moves in the direction of arrow B. Hydraulically locking the control chamber 240 prevents movement of the piston in direction of arrow A. Venting the control chamber 240 to a low pressure region (such as a tank) allows the piston to move in the direction of arrow A. Due to the working area 300 H1 of the piston that faces the combustion chamber 291A being larger than the effective working area 200 H2 of the cylinder 320 fuel passes from the high pressure region 250 down through the central bore 323 past the non-return valve 280 through holes 338 and 339 through region 336 and is injected into the combustion chamber 291A via the injector orifices 272.

As mentioned above, surface 314 of the piston is cylindrical as is inner surface 367 of the body 212. Both surface 314 and 367 are made to tight tolerances such that the diameter of surface 314 is almost as large as diameter of surface 367, there being a difference only to allow for the piston to slide in the body. Accordingly, a seal is created between surfaces 367 and 314 alone, i.e. there is no requirement for a further O-ring seal, piston ring seal or the like, such is the accuracy in tolerance of the dimensions of surfaces 314 and 367.

Similarly, surface 322 and surface 354 are made to tight tolerances and surface 354 is only slightly larger than surface 322, sufficient to allow for a sliding fit. Accordingly, a seal is created between surfaces 322 and 354 alone, i.e. there is no requirement for a further O-ring seal, piston ring seal or the like, such is the accuracy in tolerance of the dimensions of surfaces 322 and 354.

As mentioned above cap 352 is a loose fit in recess 359. This allows for the cap 352 and cylinder 350 to move to the right or left or into or out of the paper when viewing FIG. 11 to take into account any mismatch of the axis of surfaces 314 and 367 versus the axis of surfaces 322 and 354. By allowing the cylinder 350 and cap 352 to "float" in this manner, surface 314 and 367 can be machined accurately to act as a seal and surfaces 322 and 354 can be machined accurately to act as a seal and any mismatch in the axes can be taken into account in the "float" of the cap 352.

As will be appreciated, the piston 228 is free to rotate about axis K. Any such rotation of piston 228 will result in edges 364 and 365 of abutment 316 also rotating and thereby cleaning any residue that might accumulate on abutment 366.

In a further embodiment grooves 340, whilst orientated generally radially, may include a small tangential element to their orientation. As fuel is injected the tangential element to the orientation of the groove will promote rotation of the piston 228 thereby generating the above mentioned cleaning action. Alternatively, the axis of surface 322 may be offset slightly from the axis of surface 312. This slight offset also may cause the piston 228 to rotate, thereby generating the above mentioned cleaning action of abutment 336.

Operation of the injector 210 during the four stroke cycle is as follows:

Control chamber 240 is supplied with fuel from a pump in a manner similar to control chamber 40 being supplied by pump P as shown in FIG. 5. As the piston 228 moves in the direction of arrow B under the influence of the pressure in control chamber 240 and the partial vacuum in the combustion chamber 291A as a result of the induction stroke fuel can flow from the control chamber 240 through holes 357 and 356 of cylinder 350 and through holes 325 and 324 of cylinder 320 into central bore 323 thereby priming the high pressure region 250. Continued movement of piston 228 in the direction of arrow B will result in the abutment 316 engaging abutment 366 thereby preventing further movement of piston 228 in the direction of arrow B.

Once the high pressure region 250 has expanded to its largest volume and is primed the control chamber 240 can be hydraulically locked, for example as shown in FIG. 5 in respect of high control chamber 40.

As the pressure increases during the compression stroke, piston 228 will therefore not move due to the hydraulic locking of the control chamber 240.

When injection is required the control chamber 240 will be vented to low pressure region (for example vented to tank). This will cause piston 228 to move in the direction of arrow A resulting in a lower edge of hole 324 passing an upper edge of hole 356 and also is in a lower edge of hole 325 passing an upper edge of hole 357. Once this has occurred the high pressure region 250 is isolated from the control chamber 240 and continued movement of piston 228 in the direction of arrow A will result in fluid passing from the high pressure region 250 down the central bore 323 past non-return valve 328 through holes 338 and 339, into region 336 and out of injector orifices 272 and into the combustion chamber 291.

In order to cease injection the control chamber 240 is again hydraulically locked (for example as shown in FIG. 8 where control chamber 40 is hydraulically locked). Hydraulic locking of control chamber 240 prevents further movement of piston 228 in the direction of arrow A, thereby preventing any further injection of fluid.

Movement of piston 228 in the direction of arrow B can be achieved by allowing fluid to enter the control chamber 240 under pressure from a pump and also by creating a partial vacuum in the combustion chamber 291A during the induction stroke. Downward movement of piston 228 will create a low pressure in the high pressure region 250, until such time as a lower edge of hole 324 moves below an upper edge of hole 356 and a lower edge of hole 325 moves below an upper edge of hole 357 whereupon the high pressure region 250 will then be in fluid communication with the control chamber 240 and the high pressure region will then be filled with fluid from the control chamber 240.

Figure 16:
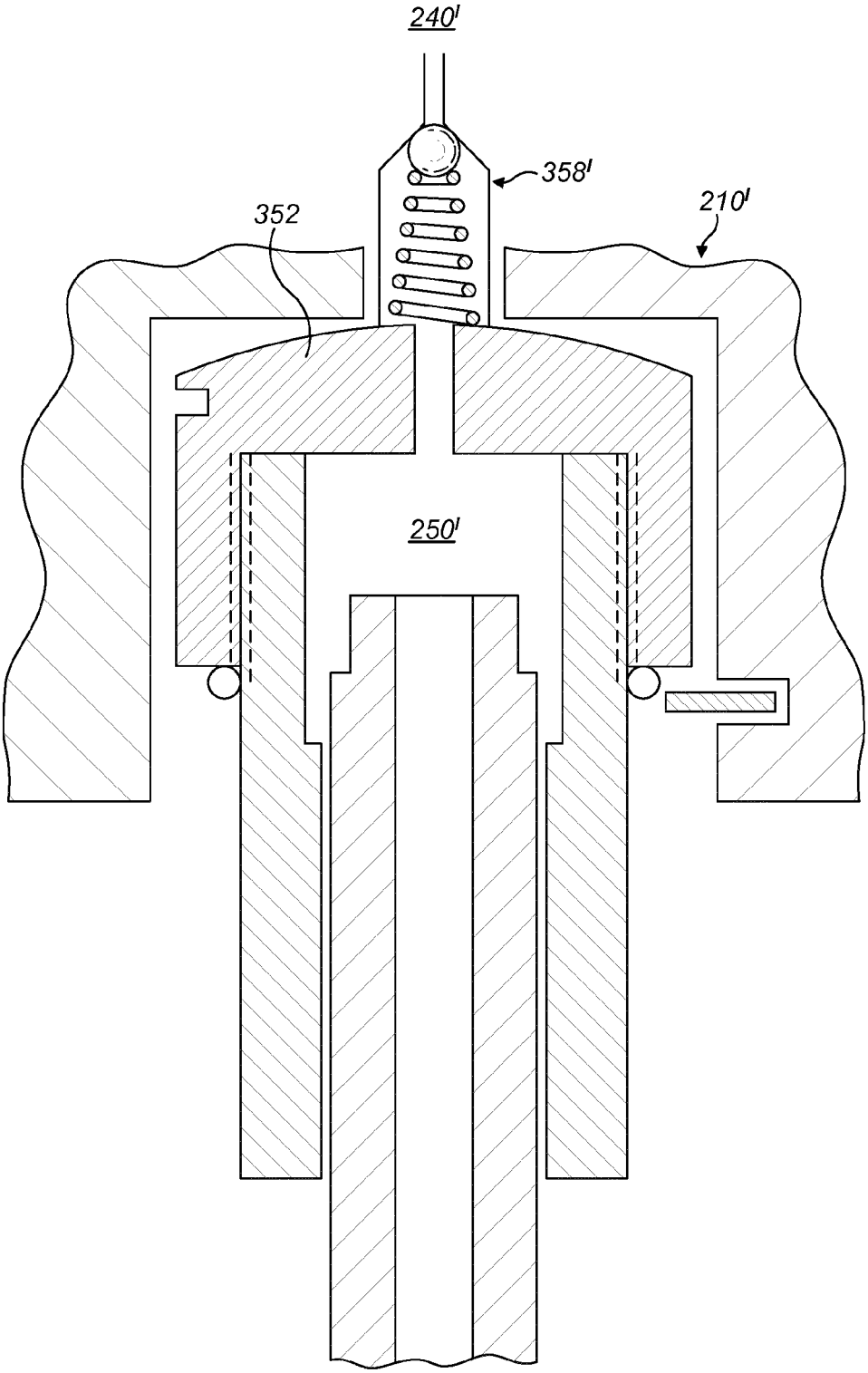
FIG. 16 shows a view similar to that of FIG. 11 of a variant of the injecting apparatus of FIG. 11.

In an alternative injector embodiment 210' (see FIG. 16), a non-return valve 358' can be fitted to cap 352'. Such a non-return valve will allow fluid to pass from the control chamber 240' to the high pressure chamber 250' to allow the high pressure region to refill (or prime) but will prevent passage of fluid from the high pressure region to the control chamber during injection of fluid into the combustion chamber. As can be seen on FIG. 16 holes 357, 325, 324 and 356 have been deleted when compared with FIG. 11.

As will be appreciated, the piston 228 and injector orifices 272 are fixed relative to each other, and as the piston moves in the direction of arrows A and B as described above, then the injector orifices 272 move in unison with the piston.

As mentioned above, grooves 340 are very shallow, for example 0.025 mm deep. The disc 334 can be manufactured by stamping or pressing or otherwise forming relatively deep grooves in edge 335. For example grooves having a depth of 0.1 mm may be pressed or otherwise formed in edge 335. Once deep grooves are formed, the part conical lands 341 can all be machined as a single machine operation, for example by grinding. In the example above if the part conical lands 341 are ground back by a distance of 0.075 mm, then the resulting groove will be 0.025 mm in depth. The disc 334 can then be assembled onto the rest of piston 228 and held in place, for example by laser welding.

Forming relatively deep grooves, and then machining the associated lands away to create shallow grooves is an efficient method of creating shallow grooves. In particular it is difficult to create injection orifices having a 0.025 mm dimension. Whilst current injection orifices may be laser drilled, such laser drilling tends to create larger holes, for example 0.1 mm in diameter.

The advantage of a 0.025 mm injection orifice 272 is that a meniscus effect of the fuel to be injected within the injector orifice 272 tends to stop injection quickly once the control chamber 240 has been vented to a low pressure region. This quick cessation of injection is advantageous since "fuel dribble" of prior art injectors after injection tends to create pollutants.

Figure 14:
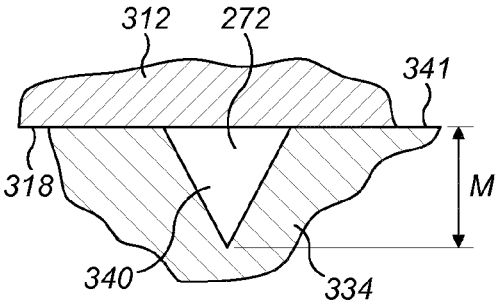
FIG. 14 shows a part view of FIG. 11 taken in the direction of arrow L.

FIG. 14 shows a view of FIG. 11 taken in the direction of arrow L, i.e. taken towards an injector orifice 272. Injector orifice 272 is formed by a combination of the V-shaped groove 340 and angled edge 318. As will be appreciated the injector orifice 272 is non-circular. In this case it is triangular in shape having three generally flat edges.

Figure 15:
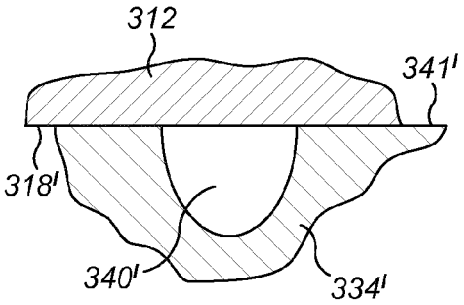
FIG. 15 shows a view similar to that of FIG. 14 with an alternatively shaped groove.

FIG. 15 shows an alternative shape of groove 340', which in this case is generally U-shaped. Again, the injector orifice is non-circular. In this case injector orifice has one generally flat portion, in this case only one generally flat portion, formed by the angled edge 318 of the generally cylindrical path 312. In further embodiments alternative shaped grooves could be used.

As will be appreciated, for two holes having the same cross-section area, the length of the periphery of the non-circular hole will be greater than the circumference of the circular hole. Thus, non-circular injector orifices have a net effect of increasing the surface area exposed as a jet of fuel enters the combustion chamber and this assists in fuel air mixing and combustion.

The annular piston 28 of injector 10 advantageously provides a central orifice for other components of the injector to project through, in this case the injector valve projects through the orifice. Such an arrangement allows for a piston to move axially and an injector valve to remain stationary relative to the body of the injecting apparatus. Advantageously, when such an injecting apparatus is used as a "retro fit" item, in place of a different type of injecting apparatus, the injector valve can be positioned stationary at the same position as the injector valve originally fitted to the engine. This means that clearances, in particular piston to injector clearances can be maintained as per the original design of the engine.

Advantageously, the control valve 60 used in conjunction with first solenoid 14 and first valve 16 provides a method of quickly closing the fluid path between region 49 and 52. This therefore quickly hydraulically locks control chamber 40 and hence quickly ceases fuel injection.

Advantageously, the provision of first solenoid 14 which operates first valve 16 and second solenoid 18 which operates second valve 20 allows the "sink" or "dwel" time of the first and second solenoid to be taken into account. First solenoid 14 is normally closed and second solenoid 18 is normally open. Thus, FIG. 5 shows the condition where first solenoid 14 and second solenoid 18 are unpowered, i.e. no electrical power has been fed to the first solenoid 14 or second solenoid 18. FIG. 6 shows the start of injection wherein normal closed solenoid 14 has been powered so as to open valve 16. However, at the end of injection it is not valve 16 which is closed, rather it is valve 20 which is closed by powering normally open solenoid 18 (see FIG. 8). As will be appreciated, the time period between starting injection and ending injection is relatively short (typically time taken for a crank shaft to rotate a few degrees with piston near the top dead centre position). By providing two solenoids associated with two valves enables start and finish of injection to be achieved within a short time period by powering one solenoid and soon after powering the other solenoid.

The injector nozzle shown in FIG. 11 which includes a disc having a plurality of injection of injector orifices situated around the periphery of the disc is advantageous because the fuel is injected over a relatively large diameter (i.e. the diameter of the disc). This distributes the fuel within the combustion chamber well. Furthermore, having many orifices, for example at least 50 orifices or at least 100 orifices, with each orifice having a small cross section dimension (for example 0.05 mm, or less than 0.025 mm) again results in good distribution of the fuel within the combustion chamber and also good atomisation of the fuel.

Advantageously by combining the injector nozzles of FIG. 11 with the piston results in the injector nozzle moving during injection and hence better distributing fuel within a combustion chamber.

As will be appreciated, the injection pressure of the fuel (i.e. the pressure in the high pressure chamber 250) is dependent upon the pressure within the combustion chamber. The pressure within the combustion chamber is dependent upon, amongst other things, the piston position, and also the degree of combustion that has taken place. Thus, the injectors 10 and 210 inject fuel at a varying pressure. The initial injection pressure will primarily dependent upon compression ratio of the engine and the particular piston position when injection is started. During injection the piston will continue to move, but more significantly fuel which has been injected at the start of injection will have started to burn which in turn increases the cylinder pressure and hence increases the injection pressure of the subsequent fuel injected towards the latter part of an injection cycle. Thus, the initial fuel being injected at a relatively low pressure may not penetrate into the combustion chamber as far as fuel injected later in the injection period which will be injected at a higher pressure. Again this distributes the fuel well within the combustion chamber since the initial fuel injected will remain relatively close to the injection nozzles whereas the fuel injected later on in injection process will travel further away from the injector orifices.

As mentioned above, the injection pressure is H1/H2 times the combustion chamber pressure. H1 and H2 can be varied dependent upon the particular engine. However, H1 and H2 can be arranged such that the injection pressure is above 35,000 psi, preferably above 40,000 psi, preferably above 45,000 psi. Such high injection pressures are considerably above those found in known injector systems and the high injection pressure atomises the fuel to very small particle sizes which in turn substantially eliminates particulates. As such, engines fitted with injectors according to the present invention may not require exhaust after treatment systems, for example particulate filters. By minimising the amount of particulate produced, the combustion process can be arranged to occur at lower combustion chamber temperatures which in turn reduces NOx production. Accordingly, engines fitted with injectors according to the present invention may not require exhaust after treatment systems in respect of NOx.

As mentioned above, piston 28 can be caused to rotate, and advantageously any deposits that may tend to collect on abutment 366 will be removed by the circumferentially orientated edges 364 and 365 thereby ensuring full piston travel throughout the life of the injector 210. Similarly piston 28 is free to rotate.

As will be appreciated, piston 28 and 228 move in the direction of arrow A during injection. This movement increases the volume of the combustion chamber and, in effect, changes to the mechanical overall compression ratio. When the engine is running at low power then a relatively small amount of fuel is injected and the piston moves in the direction of arrow A by a relatively small amount. When the engine is running at high power, a relatively large amount of fuel is injected and the piston moves in the direction of arrow A by a relatively large amount. Thus, when running at low power the engine is running at a relatively high compression ratio, whereas when running at high power the engine is running at a lower compression ratio. This is advantageous because it helps to promote cooler combustion which gives rise to lower NOx levels. Movement in the direction of arrow A of the piston may change the compression ration by 1.0 point or more. Alternatively movement of the piston in the direction of arrow A may change the pressure ratio by 1.5 points or more.

For the avoidance of doubt, reducing the compression ratio by 1.0 points means, for example, a nominally 15:1 compression ratio becomes a 14:1 compression ratio or a nominally 16:1 compression ratio becomes a 15:1 compression ratio.

As will be appreciated, the piston only moves in the direction of arrow A during injection. Once the high pressure region has been refilled (or primed) by the piston moving in the arrow of direction B, the piston remains in that (lowered when viewing the figures) position until the next injection point. This means that during the exhaust stroke the volume of the combustion chamber is smaller (since the compression ratio is higher) and this assists in venting the exhaust gases since fewer residual exhaust gases remain in the combustion chamber once the exhaust valve has closed. Thus, a moveable piston has the dual advantage of varying the compression ratio on the compression stroke but keeping a high compression ratio on the exhaust stroke.

The invention claimed is:

1. An injecting apparatus for injecting a fluid under pressure into an associated chamber, the injecting apparatus comprising:

a body, a piston movable in the body under the action of fluid pressure in the associated chamber acting from externally against the piston, the piston being operable to compress in a high pressure chamber fluid to be injected into the associated chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the piston defines a first piston working area facing an associated chamber, the piston first working area being annular, wherein the first piston working area is defined by a first outer periphery having an outer sealing surface for movement relative to a first component of the injector and by a first inner periphery having a first inner sealing surface for movement relative to a second component of the injector, and wherein the second component is fixed relative to the body.

2. The injecting apparatus as defined in claim 1 wherein the first component is fixed relative to the body.

3. The injecting apparatus as defined in claim 2 wherein the first component is defined by the body.

4. The injecting apparatus as defined in claim 3 wherein the first component is defined by a recess in the body.

5. The injecting apparatus as defined in claim 1 wherein the second component is a valve member of an injector valve, the valve member being fixed relative to the body.

6. The injecting apparatus as defined in claim 1 wherein the piston defines a second piston working area being in fluid communication with the high pressure chamber.

7. The injecting apparatus as defined in claim 6 wherein the second piston working area is annular.

8. The injecting apparatus as defined in claim 6 wherein the second piston working area is defined by a second outer periphery and a second inner periphery.

9. The injecting apparatus as defined in claim 8 wherein the first piston working area is defined by a first outer periphery having an outer sealing surface for movement relative to a first component of the injector and by a first inner periphery having a first inner sealing surface for movement relative to a second component of the injector, and wherein the first outer periphery has a diameter larger than the second outer periphery.

10. An injecting apparatus for injecting a fluid under pressure into an associated chamber, the injecting apparatus comprising:

a body, a piston movable in the body under the action of fluid pressure in the associated chamber acting from externally against the piston, the piston being operable to compress in a high pressure chamber fluid to be injected into the associated chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the piston defines a first piston working area facing an associated chamber, the piston first working area being annular, wherein the piston defines a second piston working area being in fluid communication with the high pressure chamber, wherein the second piston working area is defined by a second outer periphery and a second inner periphery, wherein the first piston working area is defined by a first outer periphery having an outer sealing surface for movement relative to a first component of the injector and by a first inner periphery having a first inner sealing surface for movement relative to a second component of the injector, and wherein the first outer periphery has a diameter larger than the second outer periphery, and wherein the first inner periphery has a diameter equal to a diameter of the second inner periphery.

11. The injecting apparatus as defined in claim 9 wherein the first inner sealing surface of said first inner periphery defines a sealing surface of the high pressure chamber.

12. The injecting apparatus as defined in claim 5 wherein a part of the valve member is received in the high pressure chamber.

13. An injecting apparatus for injecting a fluid under pressure into an associated chamber, the injecting apparatus comprising:

a body, a piston movable in the body under the action of fluid pressure in the associated chamber acting from externally against the piston, the piston being operable to compress in a high pressure chamber fluid to be injected into the associated chamber, the piston being movable against the action of fluid pressure in a control chamber whereby movement of the piston is selectively controllable by controlling the fluid in the control chamber, an injector valve and an associated injector orifice in selective fluid communication with the high pressure chamber whereby high pressure fluid from the high pressure chamber can be injected through the injector orifice upon opening of the injection valve, wherein the injector valve defines a first valve member movable relative to a second valve member, the second valve member being fixed relative to the body of the injector.

14. The injecting apparatus as defined in claim 13 wherein the second valve member includes an injection orifice.

15. The injecting apparatus as defined in claim 13 wherein the first valve member is movable relative to the second valve member to selectively define the orifice.

16. The injecting apparatus as defined in claim 15 wherein the injector valve is a pintle injector valve.

17. The injecting apparatus as defined in claim 13 wherein a seal is defined between the second valve member and the piston to isolate the high pressure chamber from the associated chamber.

18. The injecting apparatus as defined in claim 13 wherein a seal is defined between the first valve member and the body to isolate the high pressure chamber from the control chamber.

* * * * *